US005299487A

United States Patent [19]

Bertiller et al.

[11] Patent Number: 5,299,487

[45] Date of Patent: Apr. 5, 1994

[54] WEAPONS SYSTEM WITH AT LEAST ONE BARREL

[75] Inventors: Roland Bertiller, Schramberg; Helmut Reudelsterz, Oberndorf; Friedhelm Kersting, Brakel, all of Fed. Rep. of Germany

[73] Assignee: Mauser-Werke Oberndorf GmbH, Oberndorf, Fed. Rep. of Germany

[21] Appl. No.: 997,601

[22] Filed: Dec. 28, 1992

Related U.S. Application Data

[63] Continuation-in-part of Ser. No. 807,073, Dec. 13, 1991, abandoned.

[30] Foreign Application Priority Data

Dec. 17, 1990 [DE] Fed. Rep. of Germany ..... 4040327

[51] Int. Cl.[5] ..... F41A 9/29; F41A 9/35; F41A 9/56

[52] U.S. Cl. ..... 89/33.14; 89/1.41; 89/37.02

[58] Field of Search ..... 89/1.41, 33.1, 33.14, 89/33.16, 33.17, 33.02, 37.01, 37.02, 126, 127, 33.2, 33.25, 34, 45, 46

[56] References Cited

U.S. PATENT DOCUMENTS

| | | | |
|---|---|---|---|
| 2,466,893 | 4/1949 | Holton | 89/33.2 |
| 4,669,355 | 6/1987 | Schmid et al. | 89/33.1 |
| 5,076,138 | 12/1991 | Mannhart et al. | 89/33.16 |

*Primary Examiner*—Stephen M. Johnson
*Attorney, Agent, or Firm*—McGlew and Tuttle

[57] ABSTRACT

A weapons system (10) with at least one barrel (12) is provided, wherein the barrel is arranged on a weapon carrier (14) which is mounted by trunnions (16) between cradle supports (18), and its elevation is adjustable. A separate ammunition container (26, 28), which is connected to the corresponding barrel (12) by an ammunition feed canal (22, 24), is associated with the barrel (12). The ammunition feed canal (22, 24) has a rigid first canal partial section (36, 44) and a rigid second canal partial section (38, 46), which are connected to one another via arc-shaped connection end sections (40, 42; 48, 50). The connection end sections (40, 42; 48, 50) are provided at the corresponding trunnion (16) such that the connection between the barrel (12) and the associated ammunition container (26, 28), and consequently excellent ammunition feed, are guaranteed in any desired elevation position.

8 Claims, 3 Drawing Sheets

WEAPONS SYSTEM WITH AT LEAST ONE BARREL

This is a continuation-in-part application of application Ser. No. 07/807,073 filed Dec. 13, 1991 now abandoned.

FIELD OF THE INVENTION

The present invention pertains to a weapons system with at least one barrel which is arranged on a weapon carrier which is in turn mounted by means of trunnions between two cradle supports, the cradle supports extending in an upward direction from an upper gun carriage, the weapon carrier being adjusted in elevation or height by means of a drive mechanism, and more particularly to an associated ammunition feed canal connected to an ammunition container which ammunition feed canal opens with a feed section into the barrel.

BACKGROUND OF THE INVENTION

To reach a high firing rate with such a weapons system, unhindered, rapid ammunition feed is required. Ammunition feed presents no problems in the case of weapons systems with stationary barrels, but the situation is different in the case of weapons systems with barrels with adjustable elevation or height. Therefore, the firing rate of weapons systems of the latter type, i.e., weapons systems with barrels with adjustable elevation, still leaves something to be desired. Moreover, in the case of weapons systems with elevation-adjustable barrels, the highest firing rate is not available immediately, but only after a certain start-up phase, which can be considered to be another shortcoming of the prior-art weapons systems.

SUMMARY AND OBJECTS OF THE INVENTION

A primary object of the present invention is to provide a compact weapons system of the type mentioned in the introduction, in which simple ammunition feed is possible, and in which the highest firing rate is also immediately available.

According to the invention, a weapons system is provided with at least one barrel wherein the barrel is arranged on a weapon carrier and the weapon carrier is mounted by means of trunnions between two cradle supports extending in an upward direction from an upper gun carriage. The weapon carrier may be adjusted in elevation or height by means of a drive mechanism rotating the trunnions. An ammunition feed canal is provided connected to an ammunition container. The ammunition feed canal opens, with a feed section into the barrel. The ammunition feed canal is provided with a rigid first canal partial section and a rigid second canal partial section which is associated with the ammunition container. The first and second canal partial sections are connected to one another by means of connection end sections fitted together in a positive-locking manner. The first canal partial section is provided with a feed section opening into the barrel. The first canal partial section has a connection end section located farther away from the feed section which is designed as an arc-shaped section arranged at one of the two trunnions such that it is concentric with the trunnion. The second canal partial section is provided with a connection end section located farther away from the ammunition container and is provided with an arc-shaped portion adapted to the outer shape of the first canal partial section arc-shaped connection end section to thereby connect the two connection end sections in any height or elevation position of the weapon carrier.

The connection between the two connection end sections being by telescoping into and out of each other, or through a common side. If the connection is through a common side, then that side could be a radial side or a circumferential side. A common radial side would have the two connection end sections be axially side-to-side or along side each other. A common circumferential side would have the two connection end sections radially next to each other, as in one on top of the other.

The arc-shaped connection end sections of the first and second canal partial sections of the corresponding ammunition feed canal engage one another in any elevation or height position of the weapon carrier. The arc-shaped connection end section of the first canal partial section engages the associated stationary arc-shaped connection end section of the second canal partial section. The first canal partial section of the ammunition feed canal is preferably designed as a canal partial section with variable longitudinal extension over a longitudinal path that is oriented in parallel to the barrel within defined movement limits corresponding to the possible recoil movement of the corresponding barrel relative to the weapon carrier.

A weapons system with a particularly high firing rate is obtained according to the invention wherein more than two barrels are arranged on the weapon carrier, uniformly distributed along a reference circle and oriented in parallel to one another. Preferably four barrels are provided on the weapon carrier and two barrels each are arranged one on top of another at a distance from one another which corresponds to the distance between the barrels located side-by-side opposite one another.

According to a further feature of the invention, a separate ammunition container is arranged on the upper gun carriage associated with each barrel. Preferably four ammunition containers are provided arranged in pairs sideways, next to the two cradle supports, on the upper gun carriage. The two ammunition containers of a lateral pair of ammunition containers, are preferably aligned and parallel to the longitudinal direction of the barrels, arranged one behind the other and laterally offsets relative to one another wherein the end faces of the ammunition containers of the corresponding pair of ammunition containers, which face one another, are located in the vicinity of the corresponding lateral trunnion.

The second canal partial section of the first ammunition container is preferably located adjacent to the lateral cradle support and is designed as a section parallel to the longitudinal direction of the barrels and as a straight section. The second canal partial section, associated with the second ammunition container that is laterally offset relative to the first ammunition container, is preferably bent back through 1800 so that its connection end section is arranged above the connection end section of the second canal partial section of the first ammunition container. The first canal partial sections, which are connected to the two lateral second canal partial sections and open into the corresponding two lateral barrels, are arranged one on top of another.

The weapons system according to the present invention is advantageously of a highly compact design; all the ammunition containers are advantageously provided on the upper gun carriage of the weapons system. The uniform distribution of the ammunition containers on the upper gun carriage leads to optimal weight distribution and consequently to the advantage that the azimuth of the weapons system in relation to a lower gun carriage, on which the upper gun carriage can be rotatably mounted, can be adjusted rapidly as a consequence of the relatively low mass moment of inertia. One particular advantage of the weapons system according to the present invention is that the ammunition feed canal between the corresponding ammunition container and the associated barrel is designed as a quasi-rigid feed canal, so that the ammunition feed from the container to the barrel is guaranteed without any problem. This makes it possible to realize a desired maximum firing rate, which is, moreover, immediately available, as was mentioned above. Due to the fact that the ammunition feed canal extends in the vicinity of one of the two trunnions, simple ammunition feed with immediately available maximum firing rate is guaranteed regardless of the actual elevation setting of the weapon carrier, so that the immediately available maximum firing rate is guaranteed at each elevation angle position.

In a weapons system according to the present invention with more than one barrel, i.e., in a weapons system with, e.g., four barrels, which is called a "four-barrel gun", it is, in addition, possible to fire each barrel individually, or to fire any desired combination of barrels. It is also possible to fire the different barrels with different firing rates. This makes the range of a firing or target field very broad.

In the weapons system according to the present invention, the lower gun carriage, which is usually designed with a rotary mount, forms an interface by which the weapons system can be integrated within greatly different systems, and the weapons system is ready to operate immediately after it has been integrated. The latter systems are, e.g., land vehicles or watercraft.

The barrel of the weapons system according to the present invention is known per se as an individual barrel; it is used, e.g., as an aircraft gun.

Further details, characteristics, and advantages will become apparent from the following description of an embodiment of the weapons system according to the present invention with four barrels, which is represented in the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
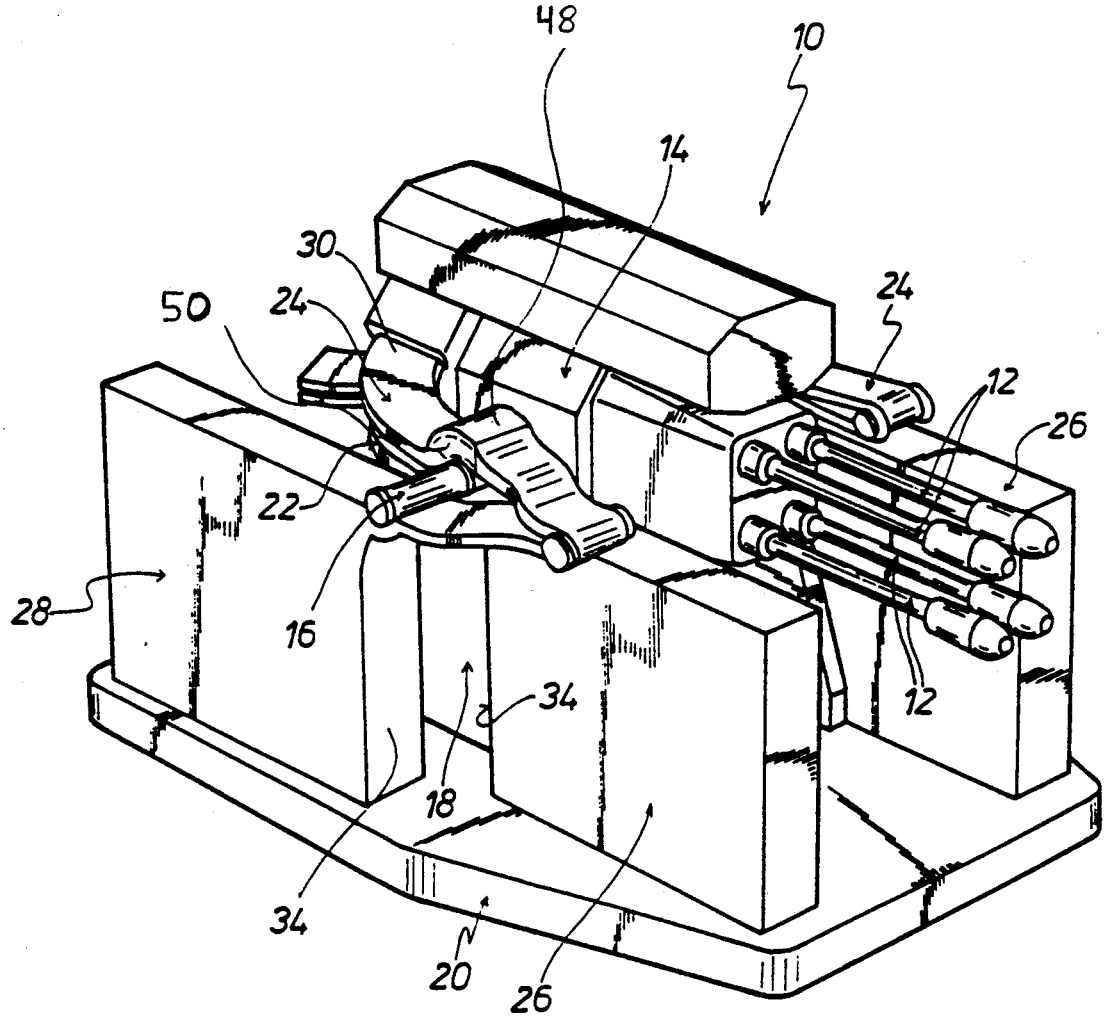
FIG. 1 shows a three-dimensional representation of the weapons system.

FIG. 1 shows a preferred embodiment of the weapons system 10, which is designed as a so-called "four-barrel gun" with four barrels 12. The four barrels 12 are fastened, oriented in parallel to one another, on a weapon carrier 14 with damping devices (not shown) in order to reduce the recoil effect.

Trunnions 16, which are laterally axially aligned with one another and point in opposite directions, extend from the weapon carrier 14. Only one of the two lateral trunnions 16 is visible in FIG. 1. With the two trunnions 16, the weapon carrier 14 is pivotably mounted on cradle supports 18, of which likewise only one is visible in FIG. 1. The two cradle supports 18, which are located at spaced locations from one another and between which the weapon carrier 14 with the barrels 12 is pivotably movably mounted, extend vertically in the upward direction from an upper gun carriage 20. The upper gun carriage 20 is preferably mounted by means of a rotary mount (not shown) on a lower gun carriage (not shown), so that any azimuth angle position between 0 and 360 degrees is possible around the vertical axis of the weapons system 10. The elevation, i.e., the height, of the weapon carrier 14 with the barrels 12 is adjustable by means of the trunnion 16. To achieve this, the weapon carrier 14 is connected to a drive mechanism.

Each barrel 12 is connected to an associated ammunition container 26 or 28, respectively, by means of an associated ammunition feed canal 22 and 24, respectively. Each ammunition feed canal 22 and 24, respectively, opens with a feed section 30 into the associated barrel 12.

Figure 3:
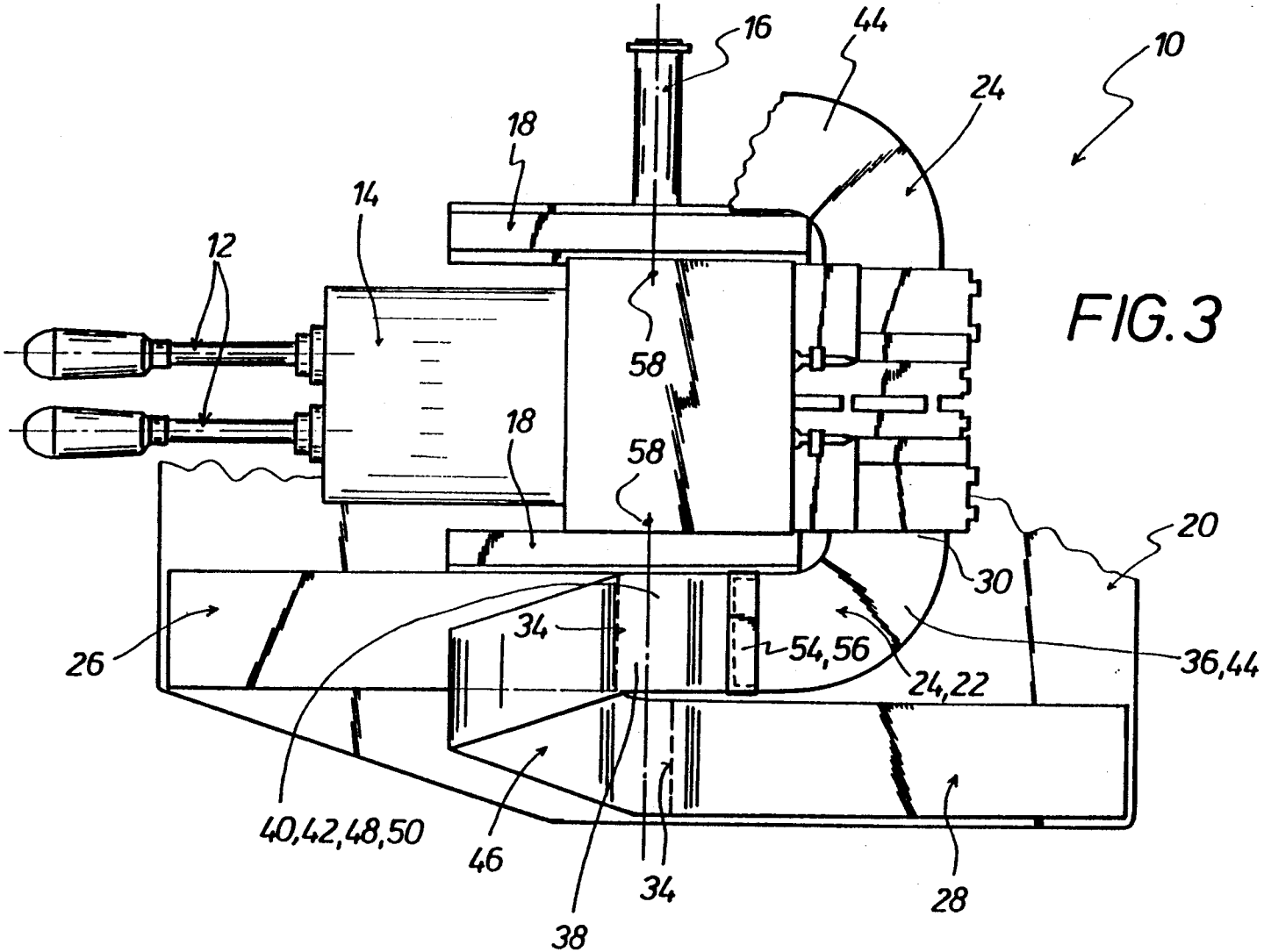
FIG. 3 shows a partial top view of the weapons system according to FIGS. 1 and 2.

FIG. 1 also shows that the ammunition containers 26 and 28 are integrated into lateral ammunition container pairs which are arranged, aligned in parallel to the longitudinal direction of the barrels 12, one behind the other in their longitudinal direction and are arranged laterally offset relative to one another. This arrangement of the ammunition containers 26 and 28, which are fastened to the upper gun carriage 20, is also clearly apparent in FIG. 3. The two ammunition containers 26 and 28 of each lateral pair of ammunition containers are arranged on the upper gun carriage 20 such that their end faces 34 facing one another are located at a short distance from one another and are located in the vicinity of the corresponding trunnion 16. This ensures compact design of the weapons system 10. FIG. 3 also shows clearly that the two ammunition containers 26 and 28 of each of the two lateral ammunition container pairs are not only arranged at closely spaced locations behind one another in the longitudinal direction of the weapons system 10, but it is also clearly seen that the ammunition containers 26 and 28 of each lateral ammunition container pair are laterally offset relative to one another in the axial direction of the trunnions 16.

The ammunition feed canal 22 of the ammunition container 26 has a first feed means or rigid first canal partial section 36, which is associated with a corresponding barrel 12. The ammunition feed canal 22 also has a second feed means or rigid canal partial section 38, which is associated with the ammunition container 26. The first canal partial section 36 and the second canal partial section 38 of the first ammunition feed canal 22 are provided with an arc-shaped connection end section 40, 42, with which the corresponding ammunition feed canal 22 is arranged on the corresponding lateral trunnion 16 such that it is concentric with the trunnion 16 and is in contact with the trunnion 16. The two arc-shaped connection end sections 40 and 42 of the ammunition feed canal 22 are designed such that they engage one another in any height or elevation position of the weapon carrier 14 and the barrels 12. Simple and reliable ammunition feed from the corresponding ammunition container 26 to the associated barrel 12 is guaranteed, so that the highest firing rate is thus immediately available for the corresponding barrel 12.

Figure 2:
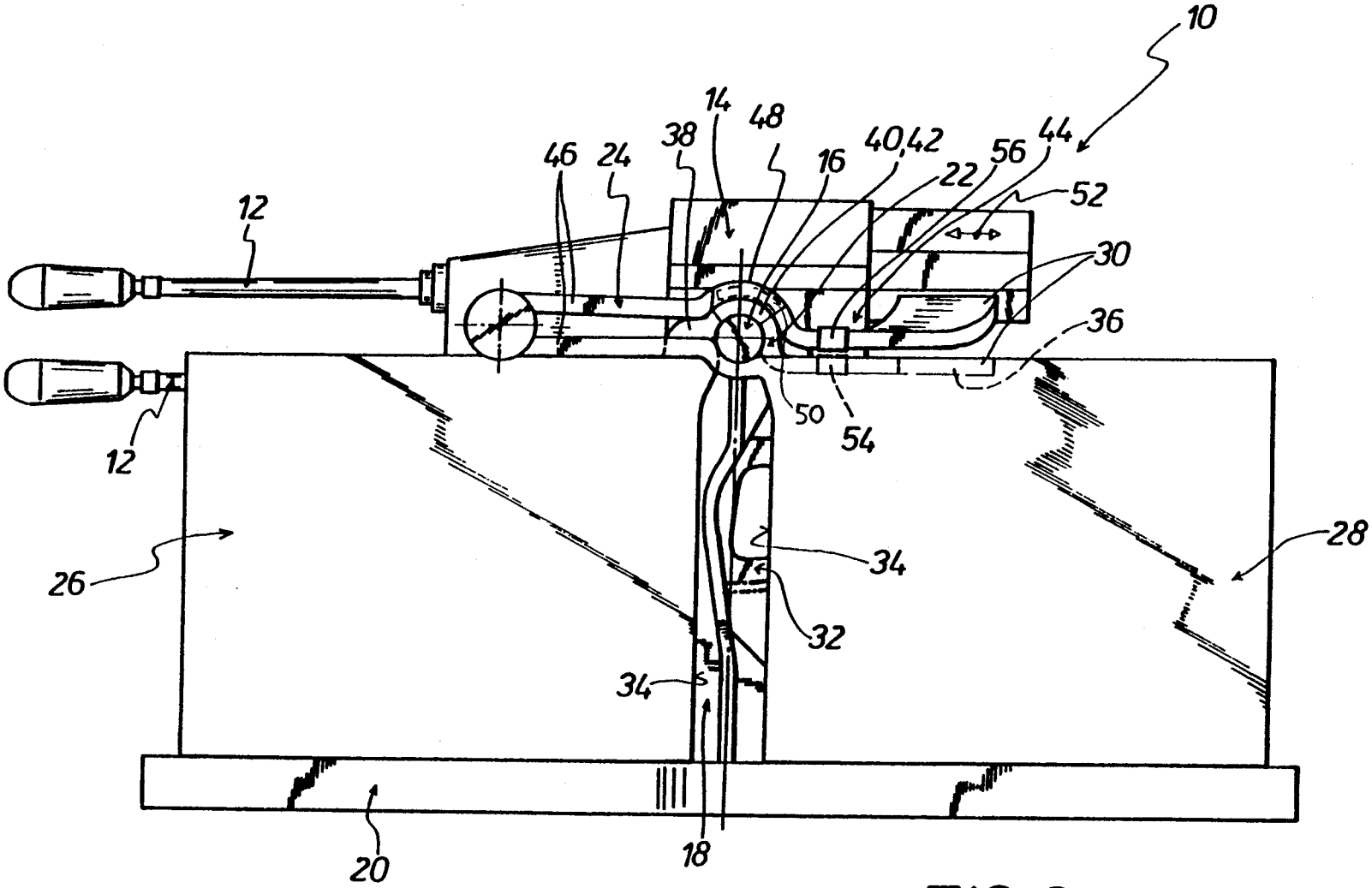
FIG. 2 shows a side view of the weapons system.

The feed section of the ammunition feed canal 22 associated with the ammunition container 26 is designated by the reference numeral 30 in FIG. 2 as well. This feed section 30 opens into the corresponding barrel 12.

The second ammunition container 28 is connected to the corresponding barrel 12 by means of the ammunition feed canal 24, which is designed, like the above-mentioned ammunition feed canal 22, with a first canal partial section 44 and a second canal partial section 46, wherein the first canal partial section 44 is associated with a corresponding barrel 12, and is provided with the feed section 30 opening into the barrel 12. The second canal partial section 46 is associated with the corresponding ammunition container 28, i.e., it is connected to it. The first canal partial section 44 of the ammunition feed canal 24 and its second canal partial section 46 are provided with an arc-shaped connection end sections 48, 50 and are arranged above arc-shaped connection end sections 40, 42 of the first ammunition feed canal 22. The arc-shaped connection end sections 48 and 50 of the ammunition feed canal 24 are designed concentrically with the corresponding trunnion 16 such that a connection is guaranteed between the canal partial sections 44 and 46 of the ammunition feed canal 24 in any height position, i.e., elevation position of the weapon carrier 14 and consequently also of the barrels 12, so that undisturbed ammunition feed from the ammunition container 28 to the associated barrel 12 is guaranteed.

The arc-shaped portions 40, 42 or 48, 50 are concentric with the trunnion upon which the weapon carrier and barrels rotate. When the weapon carrier rotates to change elevation, each of the two arc-shaped portions slide past each other since each of the arcs are substantially concentric to the trunnion axis upon which the rotation occurs.

The two arc-shaped portions can engage with one another in any height or elevation position of the weapon carrier. In the preferred embodiment, one arc-shape portion 50 engages or telescopes into and out of the other arc-shaped portion 48. Since both arc-shaped portions are concentric with the axis of rotation, this engagement is possible.

Another possible embodiment would be to have one arc-shaped portion positioned radially along side or on top of another arc-shaped portion. When the weapon carrier is rotated, the inner radial surface of the outer arc-shaped portion would slide against the outer radial surface of the inner arc-shaped portion. Ammunition transfer could then occur through the two common surfaces which are sliding against each other.

Still another form of engagement would be to have the two arc-shaped portions at the same radial distance from the axis of rotation and to have these arc-shaped portions axially adjacent. The two arc-shaped portions would then be at the same height and side-by-side. The axial surface of one arc-shaped portion would be adjacent to the axial side of the other arc-shaped portion. During rotation of the weapon carrier, these adjacent axial surfaces would slide against each other and would always engage one another at any elevation position of the weapon carrier.

The important feature in all of these different manners of engagement, is that the two arc-shaped portions must be concentric to the axis of rotation and adjacent or share a common side. If the arc-shaped portions are not concentric, then there can be no engagement in an elevation position.

In the preferred embodiment, the feed canals transport ammunition oriented or positioned substantially in parallel with a longitudinal axis of the trunnion.

As is apparent from FIG. 2, the ammunition feed canal 24 and its rigid second canal partial section 46 are designed offset through 180 degrees in order to realize the connection between the ammunition container 28 and the associated barrel 12.

Since the barrels 12 are able to perform a recoil movement in relation to the weapon carrier 14 of the weapons system 10, which is indicated by the double arrow 52 in FIG. 2, the first rigid canal partial section 36 of the ammunition feed canal 22 and the rigid first canal partial section 44 of the second ammunition feed canal 24 are designed as canal partial sections of variable longitudinal extension within defined movement limits corresponding to the possible recoil of the corresponding barrel 12 relative to the weapon carrier 14 by means of corresponding connection sections 54 and 56, respectively. To achieve this, the respective corresponding connection sections 54 and 56 are oriented in parallel to the mutually parallel barrels 12.

FIG. 3 illustrates that each ammunition feed canal 24 is not only curved through 180 degrees in the direction of the vertical axis of the weapons system 10 (cf. FIG. 2), but is also curved through 180 degrees in a more or less horizontal plane containing the central aids 58 of the trunnions 16. Identical details in FIG. 3 are designated by the same reference numerals as in FIGS. 1 and 2, so that it is unnecessary to once again give a detailed description of all these details in connection with FIG. 3. Only a section of the upper gun carriage 20 is shown in FIG. 3. Likewise, only a section of the one rigid first canal partial section 44 of the ammunition feed canal 24 is shown in this Figure in order to illustrate the one lateral trunnion 16 as well as the cradle support 18, away from which the trunnion 16 is located in a laterally spaced location.

While a specific embodiment of the invention has been shown and described in detail to illustrate the application of the principles of the invention, it will be understood that the invention may be embodied otherwise without departing from such principles.

What is claimed is:

1. A weapon system comprising:

a gun carriage;

two cradle supports mounted on said gun carriage, a weapon carrier pivotally mounted on said two cradle supports by trunnion means, said trunnion means including two lateral trunnions rotatable on said two cradle supports, said trunnion means adjusting elevation positions of said weapon carrier by pivoting said weapon carrier about said two lateral trunnions;

a barrel mounted on said weapon carrier and movable with said weapon carrier into said elevation positions;

first feed means for feeding ammunition to said barrel, said first feed means including a feed section opening into said barrel, said first feed means also having a first feed means connection end section spaced from said feed section, said first feed means connection end section being positioned adjacent one of said two lateral trunnions, said first feed means connection end section having a substantially arc-shape which is substantially concentric with said one of said two lateral trunnions, and said first feed means has means for variably extending longitudinally over a longitudinal path oriented in parallel to the barrel, within predetermined movement limits corresponding to a possible recoil movement of the barrel relative to the weapon carrier; and second feed means for feeding ammunition into said first feed means connection end section, said second feed means including a second feed means connection end section positioned adjacent said one of said two lateral trunnions, said second feed means connection end section having a substantially arc-shape which is substantially concentric with said one of said two lateral trunnions, said substantially arc-shape of said second feed means connection end section positioned adjacent to said substantially arc-shape of said first feed means connection end.

2. A weapon system comprising:

a gun carriage;

two cradle supports mounted on said gun carriage, a weapon carrier pivotally mounted on said two cradle supports by trunnion means, said trunnion means including two lateral trunnions rotatable on said two cradle supports, said trunnion means adjusting elevation positions of said weapon carrier by pivoting said weapon carrier about said two lateral trunnions;

a barrel mounted on said weapon carrier and movable with said weapon carrier into said elevation positions;

first feed means for feeding ammunition to said barrel, said first feed means including a feed section having one side opening into said barrel and another side leading to a first side of one of said trunnions, said first feed means also having a first feed means connection end section positioned at said another side of said feed section, said first feed means connection end section being positioned around said one of said two lateral trunnions, said first feed means connection end section having a substantially arc-shape which is substantially concentric with said one of said two lateral trunnions;

second feed means for feeding ammunition into said first feed means connection end section and positioned on a second side of said one of said trunnions, said second side of said one of said trunnions being substantially opposite said first side, said second feed means including a second feed means connection end section positioned around said one of said two lateral trunnions, said second feed means connection end section having a substantially arc-shape which is substantially concentric with said one of said two lateral trunnions, said substantially arc-shape of said second feed means connection end section positioned adjacent to said substantially arc-shape of said first feed means connection end section;

ammunition container means for feeding ammunition to said second feed means, said ammunition container means being mounted on said gun carriage;

another barrel mounted on said weapon carrier;

another first feed means for feeding ammunition to said another barrel, said another first feed means including another feed section opening into said another barrel, said another first feed means also having another first feed means connection end section spaced from said another feed section, said another first feed means connection end section being positioned adjacent said one of said two lateral trunnions, said another first feed means connection end section having a substantially arc-shape which is substantially concentric with said one of said two lateral trunnions;

another second feed means for feeding ammunition into said another first feed means connection end section, said another second feed means including another second feed means connection end section positioned adjacent said one of said two lateral trunnions, said another second feed means connection end section having a substantially arc-shape which is substantially concentric with said one of said two lateral trunnions, said substantially arc-shape of said another second feed means connection end section positioned adjacent to said substantially arc-shape of said another first feed means connection end section;

another ammunition container means for feeding ammunition to said another second feed means, said another ammunition container means being mounted on said gun carriage, said another second feed means connecting to said another ammunition container means by an offset portion, said offset portion turning back on itself approximately 180°, said another first feed means connection end section and said another second feed means connection end section being positioned adjacent said first feed means connection end section and said second feed means connection end section;

3. A weapon system in accordance with claim 2 wherein:

said second feed means connection end section and said first feed means connection end section telescope into an out of each other during said adjusting of said elevation positions.

4. A weapon system in accordance with claim 3, wherein:

said second feed means connection end section feeds said ammunition and said first feed means connection end section receives said ammunition during said telescoping.

5. A weapon system comprising:

a gun carriage;

two cradle supports mounted on said gun carriage, a weapon carrier pivotally mounted on said two cradle supports by trunnion means, said trunnion means including two lateral trunnions rotatable on said two cradle supports, said trunnion means adjusting elevation positions of said weapon carrier by pivoting said weapon carrier about said two lateral trunnions;

a barrel mounted on said weapon carrier and movable with said weapon carrier into said elevation positions;

first feed means for feeding ammunition to said barrel, said first feed means including a feed section opening into said barrel, said first feed means also having a first feed means connection end section spaced from said feed section, said first feed means connection end section being positioned adjacent one of said two lateral trunnions, said first feed means connection end section having a substantially arc-shape which is substantially concentric with said one of said two lateral trunnions, said first feed means feeding the ammunition around said one of said trunnions in a position substantially parallel to a longitudinal axis of said one of said trunnions; and second feed means for feeding ammunition into said first feed means connection end section, said second feed means including a second feed means connection end section positioned adjacent said one of said two lateral trunnions, said second feed means connection end section having a substantially arc-shape which is substantially concentric with said one of said two lateral trunnions, said substantially arc-shape of said second feed means connection end section positioned adjacent to said substantially arc-shape of said first feed means connection end section, said second feed means feeding the ammunition around said one of said trunnions in a position substantially parallel to said longitudinal axis of said one of said trunnions, one of said first and second feed means connection end sections is positioned in contact with said one of said trunnions.

6. A weapon system comprising:

a gun carriage;

two cradle supports mounted on said gun carriage, a weapon carrier pivotally mounted on said two cradle supports by trunnion means, said trunnion means including two lateral trunnions rotatable on said two cradle supports, said trunnion means adjusting elevation positions of said weapon carrier by pivoting said weapon carrier about said two lateral trunnions;

a barrel mounted on said weapon carrier and movable with said weapon carrier into said elevation positions;

first feed means for feeding ammunition to said barrel, said first feed means including a feed section opening into said barrel, said first feed means also having a first feed means connection end section spaced from said feed section, said first feed means connection end section being positioned adjacent one of said two lateral trunnions, said first feed means connection end section having substantially arc-shape which is substantially concentric with said one of said two lateral trunnions, said first feed means feeding the ammunition around said one of said trunnions in a position substantially parallel to a longitudinal axis of said one of said trunnions; and second feed means for feeding ammunition into said first feed means connection end section, said second feed means including a second feed means connection end section positioned adjacent said one of said two lateral trunnions, said second feed means connection end section having a substantially arc-shape which is substantially concentric with said one of said two lateral trunnions, said substantially arc-shape of said second feed means connection end section positioned adjacent to said substantially arc-shape of said first feed means connection end section, said second feed means feeding the ammunition around said one of said trunnions in a position substantially parallel to said longitudinal axis of said one of said trunnions, said first and second feed means connection end sections are positioned around a top of said one of said trunnions.

7. A weapon system in accordance with claim 6 wherein:

said first and second feed means connection end sections telescope into and out of each over a complete angular distance of said elevation positions, whereby additional telescoping portions are not needed.

8. A weapon system comprising:

a gun carriage;

two cradle supports mounted on said gun carriage, a weapon carrier pivotally mounted on said two cradle supports by trunnion means, said trunnion means including two lateral trunnions rotatable on said two cradle supports, said trunnion means adjusting elevation positions of said weapon carrier by pivoting said weapon carrier about said two lateral trunnions;

four barrels mounted on said weapon carrier and movable with said weapon carrier into said elevation positions, said four barrels being substantially aligned in parallel and spaced from each other in a substantially square shape;

four ammunition containers mounted on said gun carriage;

separate rigid first feed means, associated with each of said four barrels, and for feeding ammunition to said each barrel, each of said first feed means including a feed section opening into said barrel, each of said first feed means also having a first feed means connection end section spaced from said feed section, each of said first feed means connection end sections having a substantially arc-shape which is substantially concentric with said one of said two lateral trunnions;

separate rigid second feed means associated with separate ones of said four ammunition containers and for feeding ammunition into associated ones of said first feed means connection end sections, each of said second feed means including a second feed means connection end section having a substantially arc-shape which is substantially concentric with said one of said two lateral trunnions, said substantially arc-shape of each of said second feed means connection end sections engaging with said associated first feed means connection end sections in all of said elevation positions, and said each of said first and second connection end sections associated with one of said barrels being positioned adjacent each other in a radial direction of said trunnions;

means positioned in said each of said first feed means for variably extending longitudinally over a longitudinal path oriented substantially in parallel to said four barrels, within predetermined movement limits corresponding to a possible recoil movement of said four barrels relative to the weapon carrier.

* * * * *